United States Patent [19]

LaRooka

[11] 4,243,214

[45] Jan. 6, 1981

[54] IRRIGATION-DEBRIDEMENT-REPAIR CADDY

[76] Inventor: Mary A. LaRooka, 514 Charles St., Geneva, Ill. 60134

[21] Appl. No.: 71,111

[22] Filed: Aug. 30, 1979

[51] Int. Cl.[3] ..... A61G 13/00

[52] U.S. Cl. ..... 269/327

[58] Field of Search ..... 269/327, 328, 15; 312/229; 211/126, 127, 41; 217/30; 119/103; 220/1 C, 8, 4 B, 22.1, DIG. 6

[56] References Cited

U.S. PATENT DOCUMENTS

| | | | |
|---|---|---|---|
| 477,137 | 6/1892 | Mesich | 211/127 |
| 561,514 | 6/1896 | Lichtenstein . | |
| 876235 | 1/1908 | Quackenbass | 220/8 |
| 958,857 | 5/1910 | Dennis | 211/127 |
| 2,038,464 | 4/1936 | Wood | 211/127 |
| 2,172,331 | 9/1939 | Christensen | 211/127 |
| 2,609,261 | 9/1952 | Parker . | |
| 2,945,731 | 7/1960 | Tutrone | 269/327 |
| 3,328,024 | 6/1967 | Weil . | |
| 3,383,148 | 5/1968 | Dicken | 211/41 |
| 3,388,706 | 6/1968 | Muirheid | 220/8 |
| 3,463,343 | 8/1969 | Asenbauer | 220/8 |
| 3,920,144 | 11/1975 | Callen | 220/1 C |
| 4,082,257 | 4/1978 | Strickland | 269/328 |

*Primary Examiner*—Robert C. Watson

*Attorney, Agent, or Firm*—Hill, Van Santen, Steadman, Chiara & Simpson

[57] ABSTRACT

An irrigation-debridement-repair tray or caddy of a generally rectangular shape having a liquid-impervious body with a plurality of sterile or disinfectable liquid-permeable horizontal work surfaces and a means of draining fluid therefrom, which is useful during treatment of the extremity of a medical patient. The caddy is provided with two slidable and removable horizontal support surfaces spaced vertically apart from one another on runners fixed to the inside walls of the caddy, permitting medical personnel to begin treatment on the one of the surfaces and to complete treatment on the other sterile or disinfected surface. The caddy has semicircular cut-outs at opposite longitudinal ends thereof for receiving the extremity to be worked on, with a protective lip over each such cut-out for improved patient comfort. In one embodiment of the invention the caddy itself is formed of telescopingly-mated wall sections allowing the medical personnel to readily extend or contract the length of the tray or caddy in accordance with the length of the extremity being treated. During the treatment, any irrigation fluid or the like will simply drain through the support surface onto the bottom of the tray, which may have gutters or the like directing fluid into a waste receptacle by means of a drain tube attached along a select area of the tray bottom.

11 Claims, 6 Drawing Figures

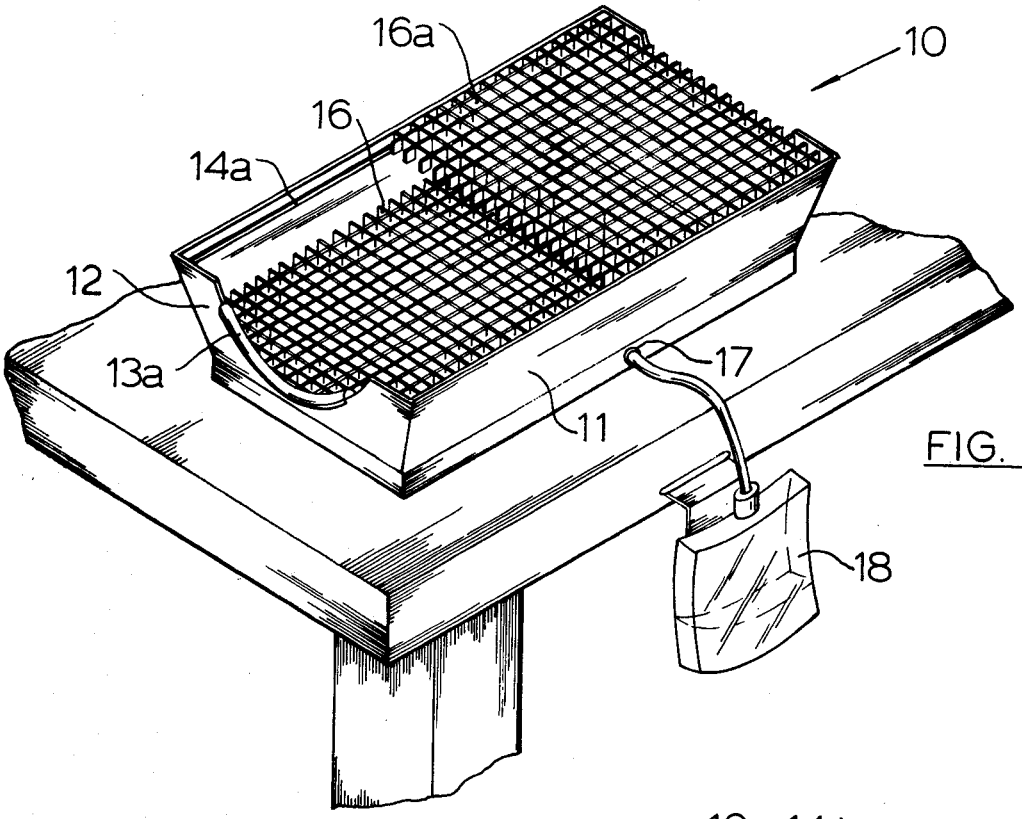
FIG. 4
FIG. 5
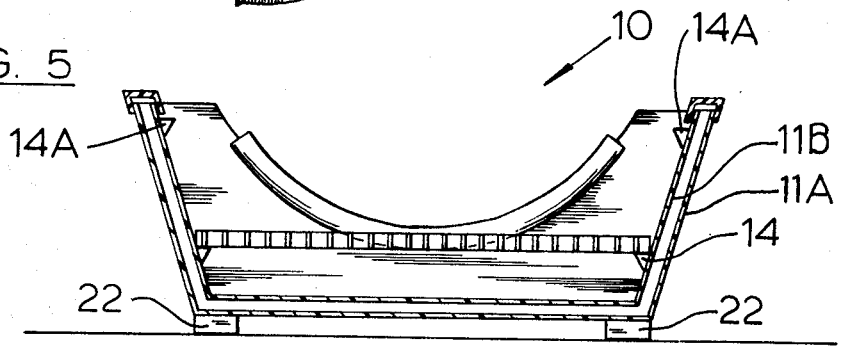
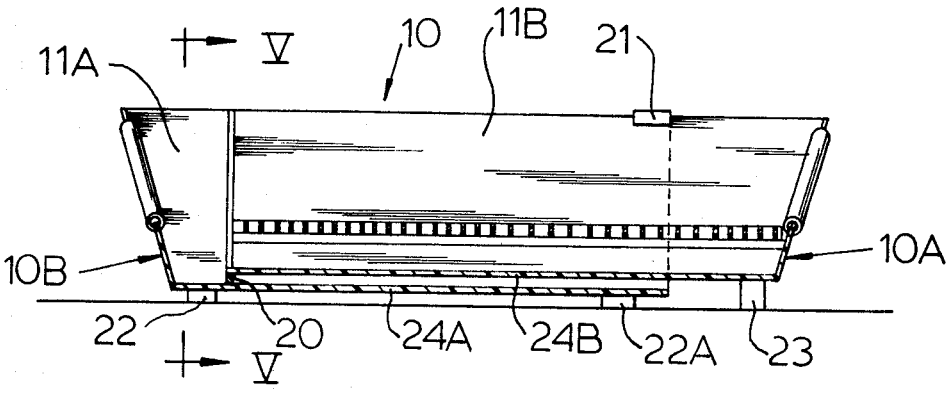
FIG. 6

IRRIGATION-DEBRIDEMENT-REPAIR CADDY

BACKGROUND OF THE INVENTION

1. Field of the Invention

This invention relates to surgical accessories and somewhat more particularly to a device for providing a plurality of clean work surfaces for supporting an injured extremity so as to enable medical personnel to treat such injured extremity.

2. Description of the Prior Art

Surgical accessories adopted to allow medical personel to perform medical treatment on a patient or a portion of a patient while collecting waste fluid or the like generated from such treatment are known. The most common type being a simple basin or towel. Other more complicated and expensive accessories are also known.

U.S. Pat. No. 561,514 shows a bandaging table with a single liquid permeable surface containing several cutouts which receive medical instruments or other items required during the bandaging procedure.

U.S. Pat. No. 2,609,261 shows a collapsible limb support which includes a screen surface having access to a drip pan.

U.S. Pat. No. 2,945,731 shows a surgical drainage attachment for use with a standard operating table. This attachment comprises a basin having a screen on the top thereof for support of a hand or foot or a patient.

U.S. Pat. No. 3,328,024 shows a drainage tray more or less permanently attached to a standard operating table having an upper screen surface and a lower drain opening.

U.S. Pat. No. 4,082,257 shows a surgery table for use on a hand and includes a downwardly sloped upper operating surface with a plurality of drain holes positioned above a drain pan, which includes a hose for disposing of wastes.

The disadvantage of the prior art are that the various devices are not readily portable and/or disposable and they are cumbersome and expensive. Also the prior art provides for only a single surface which is not readily sterilizable during usage and cannot be accommodated to the size of the extremity of the patent.

SUMMARY OF THE INVENTION

The invention provides a rectangular tray having a plurality of vertically spaced apart horizontal pairs of runner sets extending along the length of the tray to support slidable liquid-permeable operating support surfaces, means at opposite longitudinal ends of the tray for receiving injured extremities, liquid-permeable support surfaces positioned on each pair of runner and drainage means for disposing of liquid wastes collected in the bottom of the tray. In a certain embodiment of the invention the tray is comprised of telescopingly-mated sections allowing for expansion or contraction of the length of the tray.

The device of the present invention has the advantage of providing a plurality of individual, vertically spaced apart, support surfaces selectively movable into operating position whereby a treating physician has immediate access to a clean operating surface after the usage of a first operating surface, with all such surfaces having free drainage therethrough.

A further advantage of the invention is that it provides for a device whose size can be selectively changed by the treating physician to allow for the treatment of various sized extremities.

A further advantage of the invention is that it is contained in a portable, compact, inexpensive and easy to use caddy which has operating support surfaces that are readily sterilizable and disposable.

BRIEF DESCRIPTION OF THE DRAWINGS

FIG. 4 is a perspective top view of the device.

FIG. 5 is an elevated cross-sectional end view of another embodiment of the invention.

FIG. 6 is a cross-sectional side view of the FIG. 5 embodiment.

DESCRIPTION OF THE PREFERRED EMBODIMENTS

Figure 1:
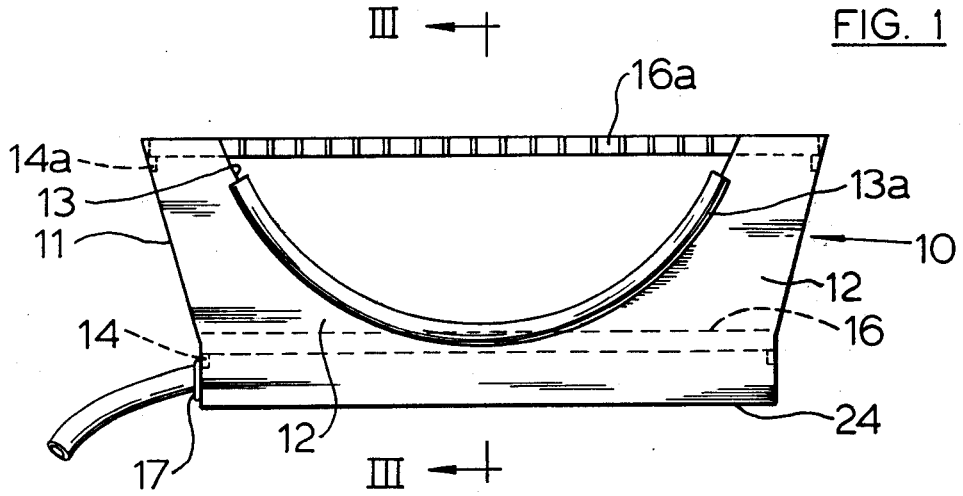
FIG. 1 is an elevated end view of an exemplary embodiment of an irrigation-debridement-repair tray constructed in accordance with the principles of the invention.
Figure 2:
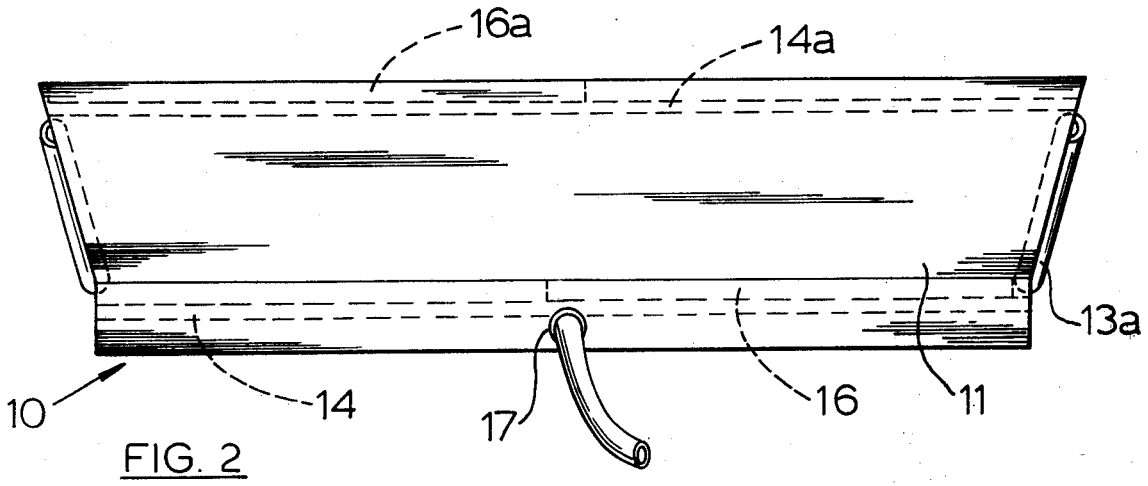
FIG. 2 is an elevated side view of the device in FIG. 1.
Figure 3:
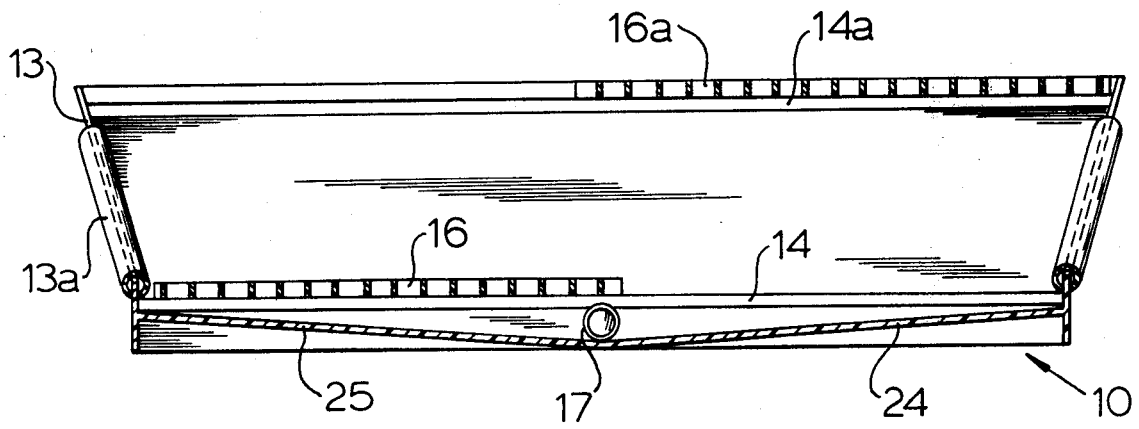
FIG. 3 is an elevated cross-sectional side view of the device of FIG. 1.

In the embodiment of the invention illustrated in FIGS. 1, 2, 3, and 4 an irrigation-debridement-repair caddy or tray body 10 is shown in the form of a rectangular tray having side walls 11, end walls 12, and a bottom wall 24 joined to one another in a liquid-impermeable manner and which can be made from metal, plastic or other suitably rigid and fluid-impermeable material, which may be disinfected or sterilized if desired. However, the tray body does not have to be disinfectable. Exemplary materials which may be used in construction of the tray are polyvinyl chloride or polystyrene. The size of the tray may be varied as desired and and a typical or convenient size is about $18\times10\times4$ inches. The side walls 11 and end walls 12 may be outwardly sloped toward the top of the caddy or tray body to allow for a larger upper operating surface 16A as compared with a lower operating surface 16, and which helps to drain waste fluids and the like during treatment and a saving in material cost while providing one large treatment surface and one smaller treatment surface. The side walls 11 and end walls 12 can be curved or sloped outwardly in a linear manner. The side walls 11 and end walls 12 may also be vertically parallel providing for equal sized operating surfaces 16 and 16A while allowing for one uniform interchangeable size for all operating surfaces. As shown in the drawings, the top of the tray is open.

The end walls 12 can have a semi-circular cut-out 13 to receive an extremity of a patient. The top edge of a cut-out 13 is provided with a protective lip 13A for added patient comfort. The lips may be molded into a desired shape or a rubber-like piece can be inserted over the cut-out. The lowest point on the protective lip 13A can be about coplanar with the top of a lower support surface 16.

In the inside of the side walls 11 near the bottom thereof, a pair or set of longitudinal lower runners 14 are provided and which may extend along the entire length of the side wall 11 or along a portion thereof. The lower set of runners 14 support a lower operating support surface 16. The support surface 16 preferably is a plastic grid or the like having a width substantially equal to that of the tray, which allows fluid to flow freely therethrough and which is sterilizable or disinfectable and may be disposable. The support surface 16 is smooth and should be capable of supporting a human extremity and can be of a length less than that of the tray so that the support surface 16 may be slidingly moved on the runners 14 to either end of the tray as needed. Near the top of the inside of the side wall 11 there is a pair or set of upper runners 14A, similar to the lower runners 14, which support an upper operating support surface 16A. The upper support surface 16A is similar in construction to the lower support surface 16. During the irrigation, debridement, or repair procedure, the physician can first work on the extremity on, for example, the lower support surface 16 preparing such extremity for a final step which can then be performed on the upper support surface 16A providing a new sterile surface.

Gutters 25 may be provided in the upper surface of the bottom wall 24 of the caddy or tray body to facilitate the collection of waste fluids and the like during operation and to direct such fluids towards an outlet means, such as a drain hose 17.

The drain hose 17 can be connected through the bottom of the side wall or through the end 12 or through the bottom wall 24 of the tray to provide for fluid drainage to a waste receptacle 18.

In an alternative embodiment of the invention illustrated at FIGS. 5 and 6, the same basic essential tray 10 is shown constructed in two sections 10A and 10B which telescopingly-mate to allow the physician to adapt the size of the tray to conform to the size of the extremity being treated. As in the above embodiment of the invention, the side walls and end walls may be curved outward, be sloped outward in a linear manner, or be vertically parallel. The side walls may be constructed so that the support runners are attached only to the inside of the side walls 11B of the inner section 10A, or the side walls 11B and 11A may have the support runners constructed as a part of the side walls so that they extend the entire length of the tray or caddy body when it is extended to its greatest length such that runners provide support along at least a portion of the length of the tray. A gasket 20 constructed of rubber or similar material is fixedly attached to the outer surface of the side walls 11A and bottom wall 24A adjacent the open end of the tray sections to provide a substantially liquid-impermeable seal between the two sections of the tray. Support feet 22, **22*a* and 23 can be fixedly attached to the bottom walls 24*a* and 24*b* to allow for level operation of the device. An overhand 21 can be constructed as part of the side wall 11** to maintain a parallel position between the respective tray sections.

As is apparent from the foregoing specification, the invention is susceptible of being embodied with various alterations and modifications which may differ particularly from those that have been described in the preceding specification and description. For this reason, it is to be fully understood that all of the foregoing is intended to be merely illustrative and is not to be construed or interpreted as being restrictive or otherwise limited of the present invention, excepting as it is set forth and defined in the hereto appended claims.

I claim as my invention:

1. An irrigation-debridement-repair tray for extremities of a human body to assist a physician in treating such extremity, comprising:

a rigid tray body having side walls, end walls and a bottom wall, said walls being fluid-impermeable and joined to one another in a fluid-impermeable manner and having an open top;

a plurality of longitudinally extending runner pairs vertically displaced from each other and positioned below a top edge of the side wall of the tray, each runner pair being fixedly attached to the inside of a respective side wall of the tray and extending at least a portion of the length of the tray;

a plurality of operation support surfaces, each positionable on a separate runner pair to receive an extremity of a human body, said surfaces being fluid-permeable; and an outlet opening at the bottom wall of the tray.

2. The irrigation-debridement-repair tray of claim 1, wherein said end walls are provided with semi-circular cut-outs therein of a size adapted for receiving the extremities of a human body, such cut-outs having a protective lip for added comfort.

3. The irrigation-debridement-repair tray of claim 2, wherein said cut-outs have an upper surface of said protective lip substantially coplanar with a lowest operating support surface.

4. The irrigation-debridement-repair tray of claim 1, wherein said support surfaces form a smooth surface and have openings therein allowing fluid and relatively small size solids to pass freely therethrough.

5. The irrigation-debridement-repair tray of claim 1, wherein said support surfaces are removable and are disinfectable and disposable.

6. The irrigation-debridement-repair tray of claim 1, wherein said support surfaces are of various lengths to accommodate differing sized extremities, all such lengths being of a maximum size substantially equal to the tray body length.

7. The irrigation-debridement-repair tray of claim 1, wherein said tray body bottom wall is provided with gutter means directing fluid toward said outlet opening.

8. The irrigation-debridement-repair tray of claim 1, wherein said tray body comprised of two telescopingly matable sections.

9. The irrigation-debridement-repair tray claim 8, wherein an outer surface of an inner section side wall and a bottom wall adjacent to an open end of the outer section are provided with a gasket fixedly mounted thereon to make a substantially liquid-impervious seal when the two sections are mated.

10. The irrigation-debridement-repair tray of claim 8, wherein an overhang is fixedly attached to an upper edge of a side wall of an outer section adjacent an open end of said section for maintaining a parallel relation between the bottom walls of said telescopingly matable sections.

11. The irrigation-debridement tray of claim 8, wherein said plurality of longitudinal runners vertically displaced from each other are parallel to a top edge of a side wall of each section, said runners being fixedly attached to the inside of a side wall of an inner section and extending the length of each section.

* * * * *